US006588747B1

(12) United States Patent
Seelig

(10) Patent No.: US 6,588,747 B1
(45) Date of Patent: Jul. 8, 2003

(54) GAME PIECE AND SYSTEM AND METHOD OF USE

(75) Inventor: Jerald C. Seelig, Absecon, NJ (US)

(73) Assignee: Atlantic City Coin & Slot Service Co., Inc., Pleasantville, NJ (US)

( * ) Notice: Subject to any disclaimer, the term of this patent is extended or adjusted under 35 U.S.C. 154(b) by 0 days.

(21) Appl. No.: 10/112,918

(22) Filed: Mar. 29, 2002

(51) Int. Cl.[7] ..... A63B 71/00
(52) U.S. Cl. ..... 273/138.1; 273/269; 273/139; 283/901; 283/903
(58) Field of Search ..... 273/138.1, 269, 273/139; 283/903, 901

(56) References Cited

U.S. PATENT DOCUMENTS

| | | | | |
|---|---|---|---|---|
| 5,046,737 A | * | 9/1991 | Fienberg | 273/139 |
| 5,158,293 A | * | 10/1992 | Mullins | 273/139 |
| 5,286,062 A | * | 2/1994 | Greenwood et al. | 283/106 |
| 5,407,200 A | * | 4/1995 | Zalabak | 273/139 |
| 5,451,052 A | * | 9/1995 | Behm et al. | 273/139 |
| 5,472,196 A | | 12/1995 | Rusnak | |
| 5,494,317 A | * | 2/1996 | Johnson | 283/72 |
| 5,562,284 A | * | 10/1996 | Stevens | 273/139 |
| 5,613,679 A | | 3/1997 | Casa et al. | |
| 5,628,684 A | | 5/1997 | Bouedec | |
| 5,671,921 A | * | 9/1997 | Quinlan | 273/139 |
| 5,685,541 A | * | 11/1997 | Lovell, Sr. | 273/139 |
| 5,743,524 A | * | 4/1998 | Nannicola | 273/139 |
| 5,772,510 A | * | 6/1998 | Roberts | 463/17 |
| 5,887,906 A | * | 3/1999 | Sultan | 283/94 |
| 5,931,468 A | * | 8/1999 | Orolin | 273/139 |
| 5,934,671 A | * | 8/1999 | Harrison | 273/139 |
| 5,944,354 A | * | 8/1999 | Feola | 283/67 |
| 5,949,042 A | * | 9/1999 | Dietz et al. | 235/375 |

(List continued on next page.)

FOREIGN PATENT DOCUMENTS

| | | | | |
|---|---|---|---|---|
| EP | 2 075 918 A | * | 11/1981 | B42D/15/00 |
| EP | 2 188 283 A | * | 9/1987 | B42D/15/00 |
| GB | 2 085 308 A | * | 4/1982 | B42D/15/00 |

OTHER PUBLICATIONS

Yusuf—Lottery Ticket Play Action Game—Pub. Date Jul. 4, 2002—Pub No.: US 2002/0084584 A1.*

Scrymegour et al. —Combination Instant Scratch–off/Break–Open ticket—Pub Date May 31, 2001—Pub No.: US 2001/0002079 A1.*

Gauthier et al. —Lottery Ticket Play Action Game—Pub. Date Aug. 15, 2002—Pub. No.: US 2002/0109294 A1.*

Schaefer et al.—Lottery Ticket With Play Action Game—Pub. Date Jan. 10, 2002, Pub No.: US 2002/0003335 A1.*

Downes et al.—Lottery Ticket Play Action Game—Pub. Date Jul. 18, 2002—Pub No.: US 2002/0093188 A1.*

*Primary Examiner*—Benjamin H. Layno
*Assistant Examiner*—Dolores R. Collins
(74) *Attorney, Agent, or Firm*—Ian F. Burns

(57) ABSTRACT

This specification discloses various types of games that preferably utilize a game ticket to provide a first game with a base award. A second or other succeeding game may provide the opportunity to multiply the award or otherwise provide additional or different (including possibly reduced or less valuable or desirable) prize. The specification discloses game tickets that preferably have hidden indicia for at least one of the games played in conjunction with the ticket, and the hidden indicia are preferably determined by scratching off a removable material. In one embodiment, the ticket includes hidden indicia for both a first game and a second game, and the second game includes a group of such indicia from which the player must pick to procure a single award multiplier. Portions of the game may be determined in conjunction with other gaming activities such as publicized multiplier determination games, announcements, or drawings.

29 Claims, 5 Drawing Sheets

U.S. PATENT DOCUMENTS 5,957,458 A * 9/1999 Haas et al. ..... 273/269
6,044,135 A 3/2000 Katz
6,076,860 A * 6/2000 Holman et al. ..... 283/109
6,145,835 A * 11/2000 Such ..... 273/139
6,146,272 A 11/2000 Walker et al.
6,210,276 B1 4/2001 Mullins
6,220,961 B1 * 4/2001 Keane et al. ..... 463/16
6,224,055 B1 * 5/2001 Walker et al. ..... 273/139
6,241,246 B1 * 6/2001 Guttin et al. ..... 273/139
6,250,685 B1 * 6/2001 Walker et al. ..... 283/49
6,273,816 B1 8/2001 Bansal et al.
6,273,817 B1 * 8/2001 Sultan ..... 463/17
6,276,683 B1 * 8/2001 Such ..... 273/139
6,296,569 B1 * 10/2001 Congello, Jr. ..... 463/17
6,347,794 B2 * 2/2002 Scrymgeour et al. .... 273/138.1
6,406,062 B1 * 6/2002 Brooks et al. ..... 283/92
6,435,500 B2 * 8/2002 Gumina ..... 273/139
6,491,297 B1 * 12/2002 Cardoso ..... 273/138.1
6,533,274 B1 * 3/2003 Heggerty ..... 273/139

* cited by examiner

GAME PIECE AND SYSTEM AND METHOD OF USE

FIELD OF INVENTION

The present invention relates to games of chance and choice. More particularly, the present invention relates to such games with award enhancement options.

BACKGROUND

Lottery games have been in existence for quite a long time. In the past few decades, for example, lottery games have become very popular for governments in raising money and providing interesting and entertaining games of chance or choice for its citizens. Other types games, such as "scratch off" ticket games, also have become very popular in commercial establishments in particular in order to provide patrons with the chance to win additional products or services from the establishments or others.

A prominent example of such lottery games is called "lotto." Lotto is commonly a jackpot game in which players purchase tickets with gaming indicia, such as number sets, printed on the tickets. Commonly, the player can choose the number sets to be printed on the ticket at the time of purchase by the player, and later, a random drawing occurs during which a winning number is generated and publicized. Often, this drawing event is itself publicized (including by conducting the drawing on television and radio) to increase excitement and awareness of the lottery game. In the event that the winning number matches a number on a player's lotto ticket, the player wins the jackpot or some portion of it in the event of multiple winners. Each winning player may then claim the appropriate award with the winning ticket in the player's possession. The game provider retains a portion of the money paid by the game players.

One example of a prior art lotto game is disclosed in U.S. Pat. No. 6,146,272, entitled "Conditional Lottery System." This prior art system is a conditional ticket system in which the system accepts and validates play entries by game players in procuring their tickets.

Another prominent prior art game of choice is called "instant lotto." In instant lotto games, each player typically purchases a ticket with a set of numbers generated for the player by, for example, a random number generation system. The player compares the numbers on the ticket with a published winning number or set of winning numbers. In the event the number on the player's ticket matches a published winning number, the player instantly wins the associated award. The establishment that issued the ticket to the player often provides the award to the player on the spot. The game provider of course retains a portion of the money paid to game players in the form of awards.

One prior art instant lotto or instant award type of game is shown in U.S. Pat. No. 5,628,684, entitled "Game System Including an Instant Win Game and a Second Game Initialized by a Winning Instant Win Game Ticket." In this game, a player that procures an instant win ticket is also, as a result of the win, offered the opportunity to play in another game such as a video game to procure an additional award from the outcome of the other, second game. The second game may be a stand-alone game or network-operated game.

In another type of prior art instant lotto game each player acquires a type of "instant" award ticket. The providing establishment provides the player with a ticket having game and/or award indicia printed on the ticket but hidden from view by a removable material that may be scratched off by the player. The player then may scratch off the removable material in order to instantly reveal the indicia and determine whether the player has earned an award and if so the nature of the award. This award may be monetary or it may be a product or service. It may also provide the option to participate in yet another game.

Another prior art "scratch-off" game is disclosed in U.S. Pat. No. 6,044,135, entitled "Telephonic Interface Lottery System." In this game, the player is provided a scratch-off ticket in order to determine if the player is an instant winner, and in addition, the player is given the opportunity to play a succeeding telephonic game.

Yet another prior art "scratch off" game is disclosed in U.S. Pat. No. 5,158,293, entitled "Lottery Game and Method of Playing Game." This type of game provides an instant lottery scratch-off game and, for winners of the scratch-off instant lottery, the opportunity to play an additional lottery game for an additional prize. See also, U.S. Pat. No. 6,219,276, entitled "Game with Multiple Incentives and Multiple Levels of Play and Combined Lottery Game with Time of Purchase Win Progressive Jackpot."

While these prior art games have offered multiple games and increased incentives and awards for lottery game players, including scratch-off lottery game players, the applicants believe that significantly more can be done to increase the number of participants and potential revenue for these types of games. The multiple gaming opportunities such as noted above tend to be time consuming and complicated, often requiring gaming skill by the participants. They also typically have not provided a sufficiently direct means of procuring increased awards, thereby providing increased incentives to participation, particularly in the context of an instant lotto or instant award type of game.

The applicant therefore has discovered that more can be done to provide scratch-off and instant award types of lottery games with more direct mechanisms of providing increased awards and incentives to play. The applicant has also discovered that, in particular, certain embodiments of scratch-off or instant award games can do so while also being less time consuming and/or without requiring the types of gaming skills often required to play prior art games.

BRIEF SUMMARY OF INVENTION

The applicant has therefore provided a lottery or instant award game, and associated game ticket or piece, that provides a lottery or instant award game to procure a base prize amount and the opportunity to procure a multiplied award of the base prize amount.

In one embodiment, the lottery game provides at least one game player with a game ticket having hidden indicia on the ticket, so that the indicia may then be revealed to the player. In this fashion, the player may determine if the player has won a base award.

In the preferred embodiment, the hidden indicia is covered by a removable material when provided to the game player. In the most preferred embodiment, this removable material can be scratched off of the ticket by the player.

The ticket or piece may provide additional indicia that may provide the player the opportunity to procure a multiplied award. Most preferably, the additional indicia additionally or alternatively is hidden and may include a plurality of such indicia from which the player may choose to possibly procure a multiplied valuable award. The multiplied award may be more valuable, but it optionally may be less valuable than the original or base award in a prior game.

The game may alternatively or in addition provide the game player with the opportunity to procure later-determined multiplied awards.

Later-determined multiplied awards may be provided by publicized gaming events. One type of a publicized gaming event can optionally provide a multiplied award to the game player in the event that an outcome in the publicized game matches an award or award multiplier previously determined in the game.

Most preferably, the game provides a plurality of tickets or game pieces to a plurality of game players, and the multiplier determination in the second or latter game may be pursuant to a progressive or other lottery game that allows for increasing award sizes with increased player participation in the first or other base game prior to the second or latter game or multiplier determination.

Optionally, the award determination in association with the ticket may, in certain instances, constitute the awarding of products or services rather than cash or credit.

The present invention thus can provide novel methods of doing business by providing the present lottery or instant award games. The methods may optionally provide revenue for the opportunity to play the present games, increased revenue from increased player participation in the games provided by the present invention, advertising revenue in association with the gaming activities including publicizing of the gaming activities or award determinations, and the ability to enhance a retail or other business by providing stimulating or loyalty-enhancing games for procuring awards from the business.

There are other aspects of the present invention and its various embodiments. They will become apparent as the specification proceeds. In this regard, it is to be understood that the scope of the present invention is to be determined by reference to the issued claims and not by whether a given embodiment meets every aspect of this brief summary or satisfies every deficiency or problem with the prior art as noted above.

BRIEF DESCRIPTION OF THE DRAWINGS

The preferred embodiments of the present invention are shown in the accompanying drawings where.

DESCRIPTION OF THE PREFERRED EMBODIMENT

In the following detailed description of the preferred embodiments, reference is made to the accompanying drawings as a part of this application. The drawings show, by way of illustration, specific embodiments in which the invention may be practiced. It is to be understood that other embodiments may be utilized and structural changes may be made with out departing from the scope of the present invention.

It is to be understood that, as used herein, the term "ticket" means not only a conventional gaming ticket but also any other game entry piece, voucher, stub, and the like. As used herein, the term "indicia" generally refers to symbols, numbers, alphabets, and the like that have distinctive or informational character, value, or meaning.

Figure 1:
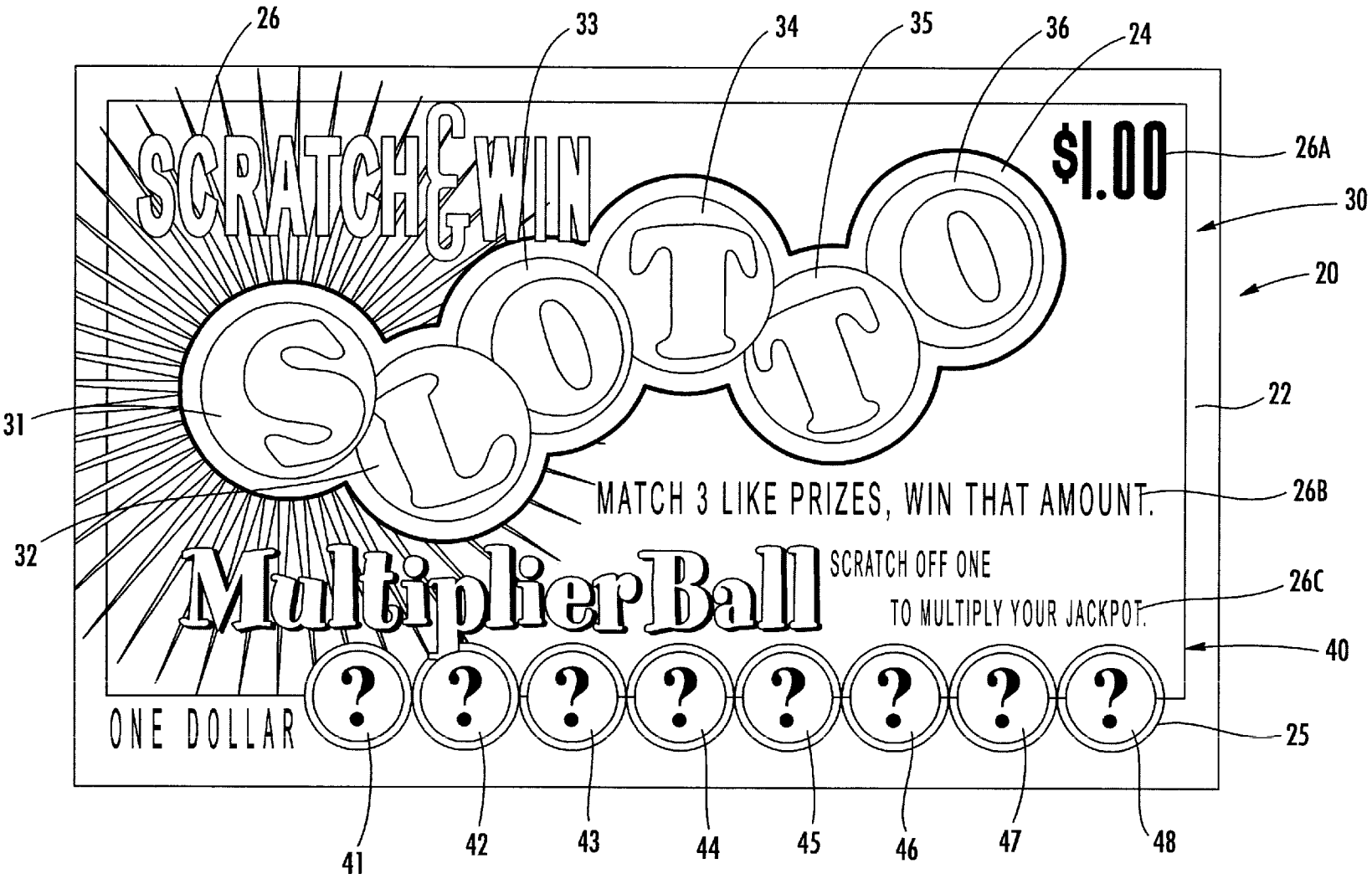
FIG. 1 is a front view of one embodiment of a preferred lottery game ticket with base game or award hidden indicia, and a plurality of multiplier award hidden indicia, covered by a scratchably removable material.

With reference now to FIG. 1, the present invention comprises a ticket, generally 20, and gaming methods of playing the ticket 20. The ticket 20 includes a unitary ticket body 22 having a first game section 30 and a second game section 40, with graphics 26 and removable coatings, e.g., 24, 25, on each such sections 30, 40. The graphics 26 preferably provide information such as the price of the game entry piece 26A and game instructions 26B. Of course, different graphical designs and phrases may be used. Graphical designs and phrases may also be placed or oriented at various locations on the ticket body 22.

Methods of making a gaming ticket 20 and removable coatings 24 are well known in the art and are commonly used to make instant lotto tickets. Materials for the ticket body 22 can include paper or plastic. Materials for the removable coating 24 include aluminum permeated latex, ink, and peel-off material such as stickers. The removable coating 24 is preferably opaque.

With continuing reference to FIG. 1, the first game section 30 has a plurality of sub-sections 31–36, and the second game section 40 also has a group of sub-sections 41–48. In the preferred embodiment shown in FIG. 1, first game section 30 includes six sub-sections 31–36.

Figure 2:
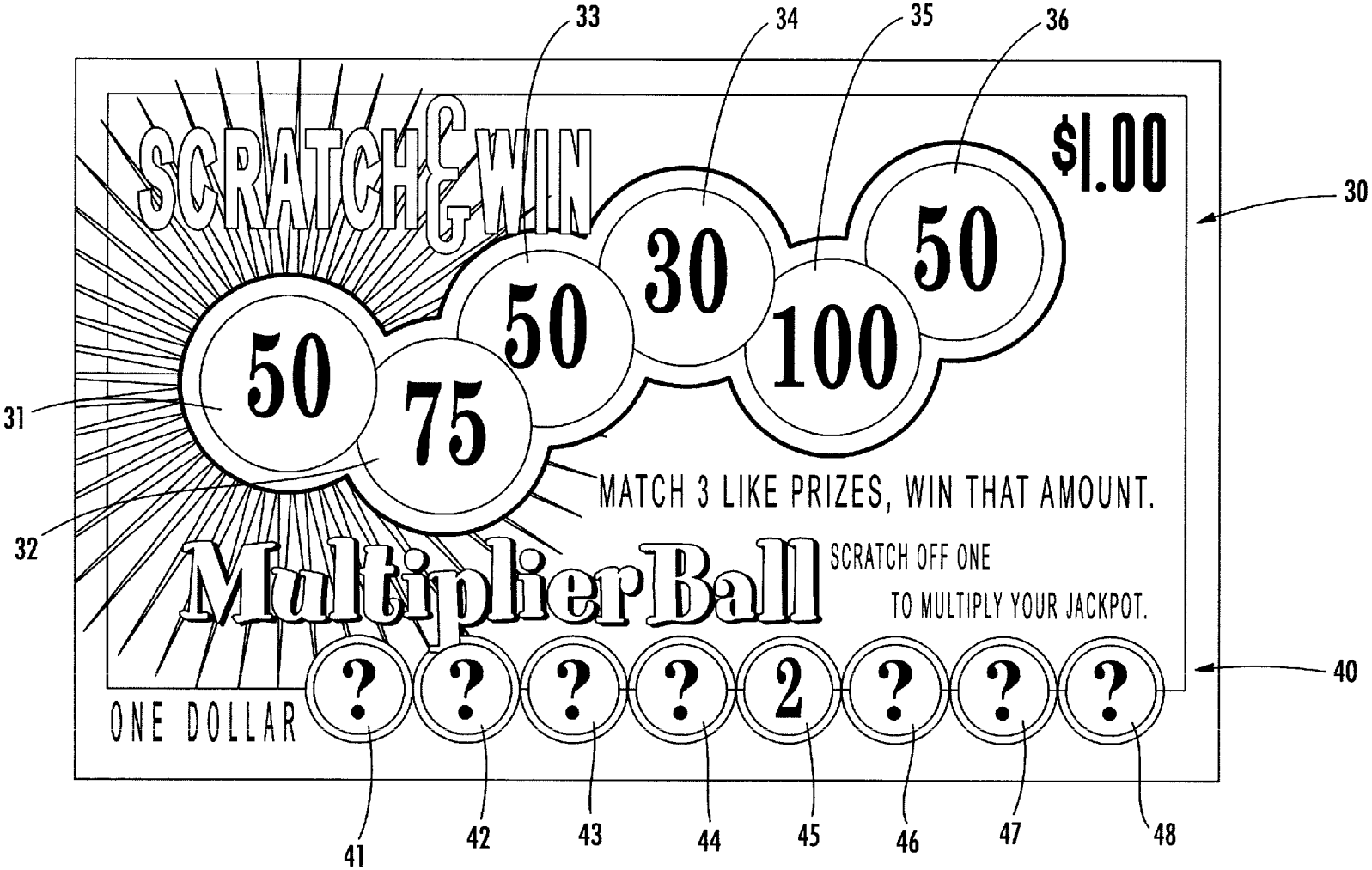
FIG. 2 is a front view of lottery game ticket of FIG. 1 with certain of the removable material removed to reveal underlying hidden indicia on the ticket.

As shown in FIG. 2, each of the first game sub-sections 31–36 and each of the second game sub-sections 41–48 contain indicia hidden covered by a removable coating, e.g., 24. When the ticket 20 is first provided to a game player, the first game outcome can be determined by the nature of those among the sub-sections 31–36 for which the player exposes the hidden indicia underlying the removable coatings covering the hidden indicia.

In the example shown, if the player were to expose only the three of the first game sub-sections 31, 33, 36 that contain the same indicia "50," the matching of these three indicia would render the player a winner of an award of fifty dollars in the first, or base, game played by the player in association with the ticket 20. This win in the first game associated with the ticket 20 would provide the game player with the opportunity to play a second game in association with second game sub-sections 41–48.

The second game sub-sections can include one or multiplier numbers as hidden indicia underlying the removable coatings on these second game sub-sections 41–48. In the example shown, the player might pick second game subsection 45 and remove the removable coating thereon to reveal hidden award multiplier indicia "2." Thus, the player's winning in the first game of a base award of $50 is multiplied by the revealed award multiplier, 2, to provide a multiplied and enhanced award to the player of $100.

It can be appreciated that this embodiment provides two games that the player can play and relatively instantly obtain game outcomes, and associated awards, including optionally enhanced awards, from the two games. If, however, the player happened to have picked two indicia, the game provider will be confused as to which indicia to multiply prize from first game with. Thus, preferably this particular game includes at least a rule requiring that player must reveal only one multiplier indicia in the second game. Otherwise, the player will be disqualified in the second game.

Figure 3:
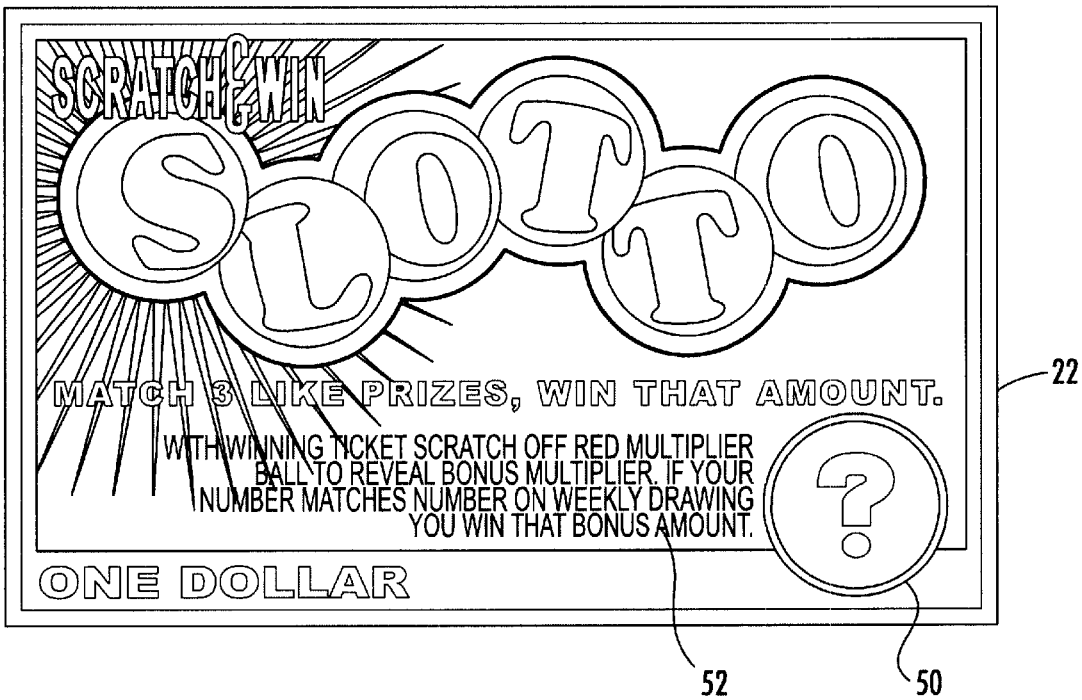
FIG. 3 is front view of a second embodiment of a preferred lottery game ticket with only a single multiplier award for possible match of the award in a subsequent game or lottery.

With reference now to FIG. 3, the preferred ticket body 22 may instead have only one multiplier indicia 50 rather than multiple multiplier indicia as in the case of the embodiment of FIGS. 1 and 2. This single indicia is also most preferably covered or hidden by a scratchably removable coating, which, when scratched off, reveals an award multiplier to the game player. In addition, the ticket body 22 in the FIG. 3 embodiment includes base award multiplier indicia 52 advising the player that the multiplier is applied to the award, to yield a multiplied award to the player, in the event the multiplier shown in multiplier indicia matches a drawing multiplier drawn in a subsequent drawing.

Most preferably, in order to increase game interest, excitement, awareness, and participation, the drawing is conducted in a well-publicized fashion at a predetermined time subsequent to the player's procurement of the ticket body 22. This publicizing effort includes conducting the drawing on television, radio, and the Internet, and promotion of the drawing through these and other media, such as the newspaper, prior to conducting it.

Figure 4:
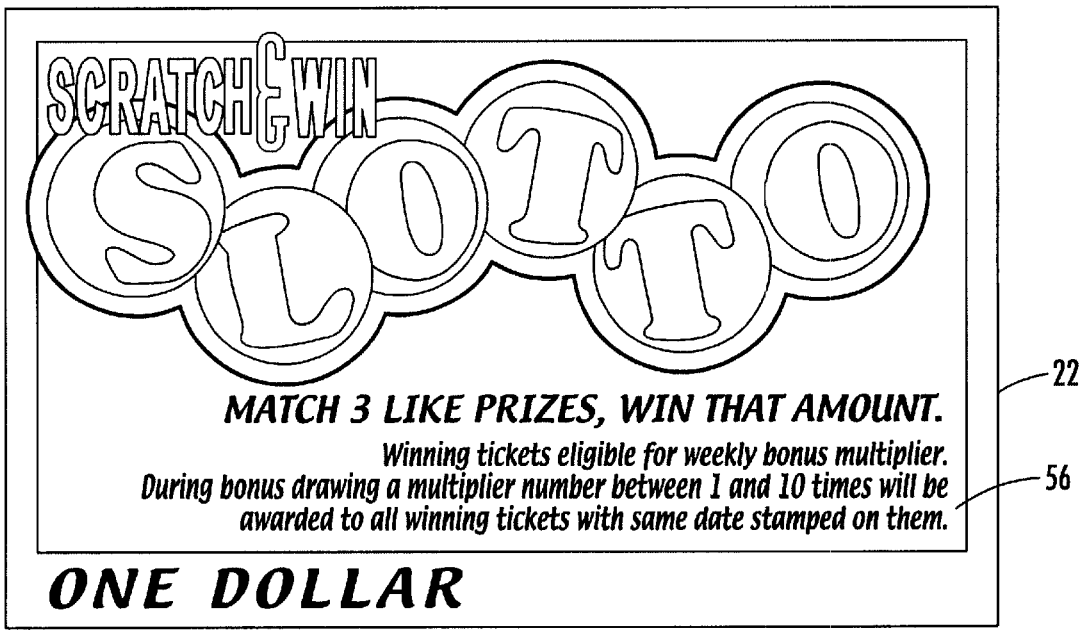
FIG. 4 is a front view of a third embodiment of a preferred ticket providing single base game or award hidden indicia and the opportunity to procure a multiplied award in a subsequent game or lottery.
Figure 5:
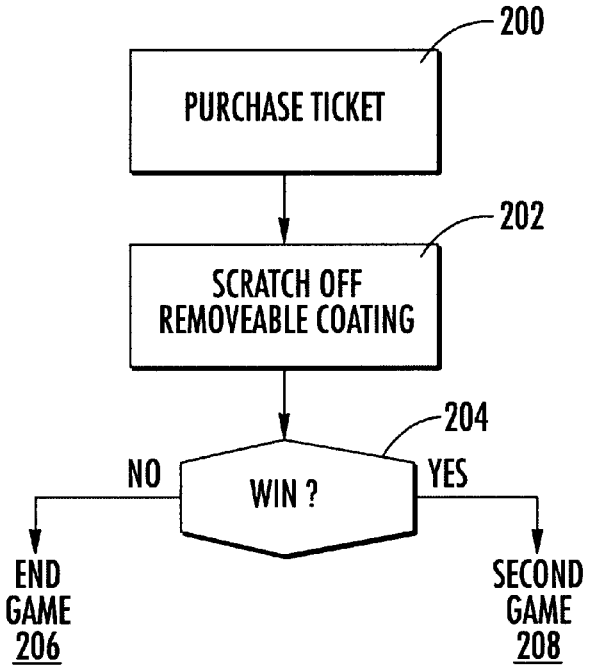
FIG. 5 is a flow chart of a preferred method of the present invention to provide a player with the opportunity to win a base scratch-off game and thereby also procure the chance to win a multiplier in a second game.

Referring now to FIG. 4, an alternative game ticket body 22 does not include a multiplier indicia, hidden or otherwise, but instead includes multiplier drawing indicia 56 and a date stamp on the back side of the ticket body (not shown). This multiplier drawing indicia preferably indicates to the game player that the player may obtain a multiplied award by a multiplier drawn at a later, publicized drawing provided the player's ticket bears a certain date stamp on its back side (not shown).

As shown in FIGS. 1–3 and 5, in step 200, the player obtains a lottery game entry piece 20 or a similar ticket from game provider. In step 202, the player scratches off the removable coating from the first game section of the ticket to play the first game. At step 204, the player determines whether the player won in the first game.

In the preferred embodiment of FIGS. 1–3 and 5, the player determines game outcome by reading from the ticket. For example, player can compare indicia obtained by scratching off removable coating. If three out of six indicia match in the example shown in these FIGS. 1–3 and 5, then player is deemed a winner. In another embodiment, the player determines the game outcome by comparing award indicia obtained by scratching off removable coating, with one or more other winning numbers randomly picked by game provider. At step 206, if player did not win in the first game, player is preferably not qualified to participate in a second or other game associated with the ticket 20.

Thus, the second (or other succeeding) game is preferably a bonus game, and the first game is preferably a base, or initial, game. Alternatively, however, the second game may be provided to the player regardless of outcome in first game. It is therefore to be understood that the terms "second game" and "bonus game" are used interchangeably herein to refer to a game after the first game or game prior to such second or bonus game.

Figure 6:
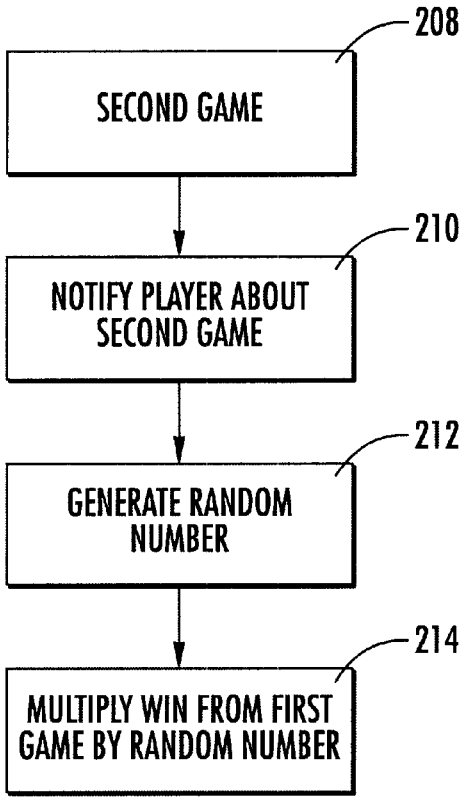
FIG. 6 is a flow chart of a preferred method of the present invention to provide a randomly determined award multiplier to a game player in a second game.

The second game may be played in various ways. In one embodiment shown in FIGS. 3 and 6, the player is provided with information regarding the second game 210. Information such as the time, place, and date of the second game is preferably printed on the ticket 20. The second game may be publicized in the same fashion set forth above. At step 212, the second game is preferably an award multiplier determination event in which the game provider most preferably generates a random number to serve as an award multiplier.

The random multiplier number may be generated using any of a wide variety of ways well known to those skilled in the art. Most preferably, the random number is generated by ball selector and display device such as described in U.S. patent application Ser. No. 09/535,075 filed on Mar. 23, 2000 and entitled Ball Selector and Display Device for use with Gaming Devices.

At step 214, the award amount that the player won in first game in step 204 is multiplied by random number generated in step 212. The player can then redeem the multiplied, and thereby preferably enhanced, award amount determined in step 214.

Figure 7:
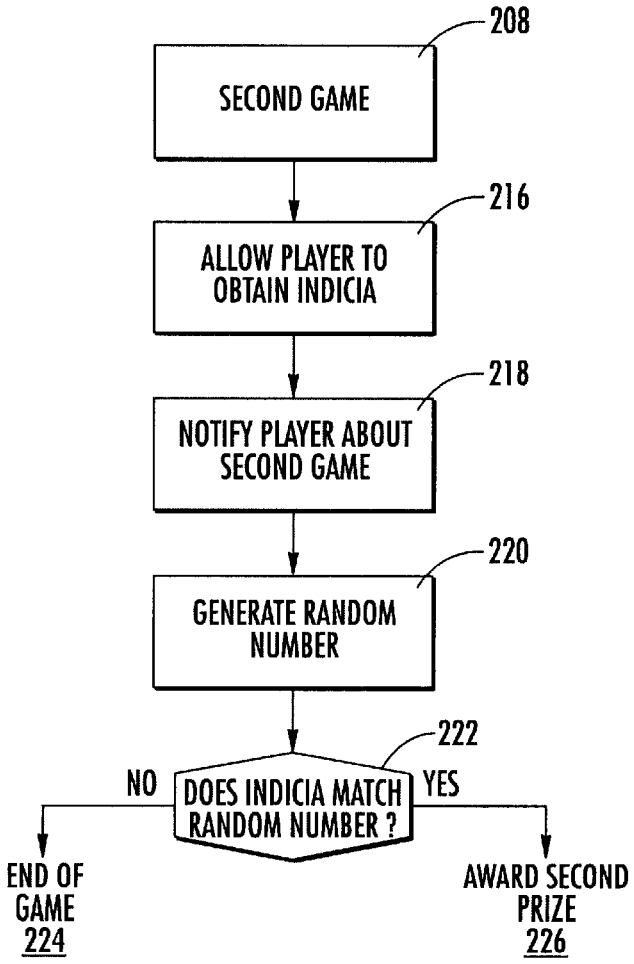
FIG. 7 is a flow chart of a preferred method of the present invention to allow a player to procure an award multiplier indicia and subsequently win that award multiplier in a subsequent randomly determined game.

With reference now to FIGS. 3 and 7, the player can be allowed to determine award multiplier values or indicia at step 216. Preferably, the player determines this multiplier indicia by scratching off removable coating from at least one sub-section of the second game section on the ticket. The player is also provided with instructions regarding the second game at step 218, preferably by printing the instructions on the ticket. These instructions preferably include information on time, place, and date of second game. The second game may be publicized as noted above.

At step 220, the second game includes generation of a random award multiplier number by the game provider. The random award multiplier number may be generated using ways well known in the art, such as de scribed above in connection with the generation of a random award multiplier number in connection with the embodiment of FIGS. 3 and 7.

At step 222, the multiplier indicia obtained by player is compared with the random award multiplier number from step 220. If the multiplier indicia does not match the random award multiplier number, then the player is not awarded a multiplied award and instead is awarded only the base award from the first game. When this occurs, the game ends for the game player in step 224. If, on the other hand, the multiplier indicia matches the random award multiplier number from step 200, then at step 226 the player is awarded a multiplied award based on the value of the multiplier indicia.

It should be noted that the second game may also provide the player with prizes or awards other than multiplied cash awards, such as awards of products or services. The additional or enhanced awards may be predetermined or determined by a game of chance, a lottery, a jackpot, or other game.

Similarly, the first or base game award may also provide similar product or service awards. They may also be determined or awarded in conjunction with varying types of games as well.

Figure 8:
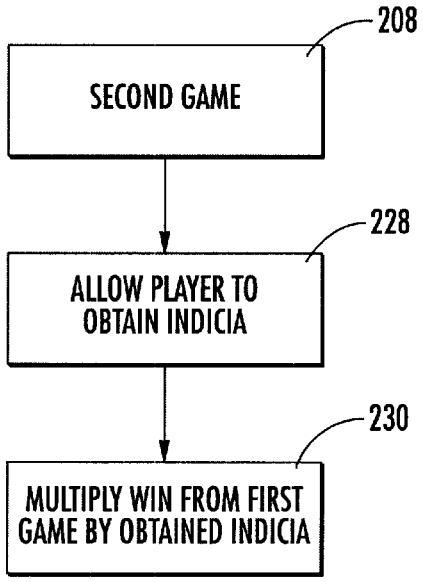
FIG. 8 is a flow chart of a preferred method of the present invention to allow a player to determine award multiplier indicia on the ticket and thereby procure an award from the base game multiplied by the award multiplier indicia.

In yet another embodiment shown in FIGS. 3 and 8, the player is allowed to determine one hidden multiplier indicia on the ticket 20 (step 228). As noted above, the player preferably determines the one multiplier indicia by scratching off removable coating from a player-chosen sub-section of the second game section. In step 230, the determined multiplier indicia provides the multiplier for multiplication of the base award amount that the player won in the first game. Thus, if the player won $50 from first game and the player determined the value of a hidden multiplier indicia with the value "2," total amount awarded to the player is $100.

It can be appreciated that this embodiment provides two games that the player can play and relatively instantly obtain game outcomes, and associated awards, including optionally enhanced awards, from the two games.

It should also be appreciated that, in any of the games described above, the second or other succeeding game could provide an award reduction value as an alternative outcome in the second or succeeding game. The player could thereby possibly procure a reduced award from participation in this second or succeeding game, and this possibility and risk could add to the excitement and interest in playing the games provided in conjunction with the game tickets disclosed herein.

It can thus be seen that the present invention can provide lottery games, games of chance, and other games that are more exciting and rewarding to play than prior art games. The present invention provides a ticket that allows for multiple games and at least a first award and a second, most preferably multiplied, award opportunity for game players. In this regard, it can be seen that the multiplier can optionally be a fraction if desired, and thus provide a multiplied award that is less than the original or base award in the first or other prior game. Most preferably, the outcome of the first and second game can provide at least substantial instant excitement to the game player by providing an opportunity to instantly scratch-off removable material to determine at least a substantial portion of the game outcome in association with the ticket.

In this regard, the first game award may be relatively low and thus allow for many game players to procure an award, most preferably instantly upon procurement of the ticket. The second game award multiplier may be relatively high (well above the number ten for example), which would greatly enhance the potential for the player to procure a large award. The latter, multiplied award can also be determined as a progressive lottery award, contingent in size on the number of participants and size of the revenue pool from which the award may be provided. In any event, the overall game can offer a much more exciting and entertaining gaming experience and increase the level of game player participation and associated revenue and profits for the gaming operator.

The present invention can, in the above-described embodiments, be quite easy to understand and play. It need not necessarily (although it could in certain embodiments) require any substantial gaming skill to play either the first game, in order to try to procure an instant award, or to play the second game when available to the game player, in order try to procure a multiplied award. At the same time, the game can provide an increased level of excitement as a result of having at least one hidden game indicia, whether the hidden indicia be as a part of the first game, the second, multiplier game, or both.

The present invention can thus provide an improved method of doing business in connection with games. One method would include providing the game as means of procuring revenue and profits from the gaming operation. The operator may charge for purchase of the tickets by game players and then, if desired, operate a subsequent multiplier awarding or determination event, which may be publicized as noted above. The operator may thus procure sales revenue from the sales of the game tickets and advertising revenue from the sales of advertising that may be placed on the ticket, displayed or otherwise announced at the point of sale of the ticket, or presented to viewers or listeners in conjunction with the multiplier awarding or determination event on television, radio, or at some other public event or location.

The present invention can also be used to increase the level of business at commercial or other establishments. For example, a retailer might provide the present game tickets to patrons in order to offer the opportunity for patrons to procure awards of items that would not only provide a level of entertainment to the patrons but also create customer loyalty and a higher customer return rate or frequency. The patrons could thus procure awards of items in a first game and the opportunity to obtain multiplied or enhanced awards or multiplied numbers of products or services through the second gaming opportunity.

The foregoing is a description of preferred embodiments. The foregoing description is thus illustrative and not itself limiting. The scope of the present invention is therefore to be determined by the scope of the issued claims and equivalents.

We claim:

1. A method of playing a game, comprising:

(A) providing a ticket to a player, the ticket comprising hidden game indicia being capable of indicating a winning event and a base prize amount;

(B) revealing the game indicia and determining (i) if a winning event has occurred and (ii) if so, an associated base prize amount;

(C) determining a prize multiplier; and (D) if a winning event occurred in the revealing and determining step (B), first multiplying the associated base prize amount by the prize multiplier to obtain a multiplied prize and subsequently awarding the multiplied prize to the player.

2. The game method of claim 1 wherein the hidden game indicia of the ticket is covered initially by a removable material when first provided to the game player.

3. The game method of claim 2 wherein the removable material may be removed by scratching the removable material off of the ticket.

4. The game method of claim 1 wherein the ticket further comprises additional hidden game indicia being capable of indicating a prize multiplier, and wherein the prize multiplier determining step (C) includes determining the prize multiplier by exposing the additional hidden game indicia on the ticket and revealing the prize multiplier.

5. The game method of claim 4 wherein the additional hidden game indicia of the ticket is initially covered by a removable material when first provided to the game player.

6. The game method of claim 5 wherein the removable material may be removed by scratching the removable material off of the ticket.

7. The game method of claim 1 wherein:

(i) the ticket hidden game indicia also is capable of indicating at least one multiplier indicator;

(ii) the revealing step (B) includes revealing at least the one multiplier indicator;

(iii) the determining step (C) includes determining a second multiplier indicator, and if the one multiplier indicator and second multiplier indicator are equivalent, multiplying the associated base prize amount by the one multiplier indicator to obtain a multiplied prize for the player.

8. The game method of claim 7 wherein the one multiplier indicator of the ticket is initially covered by a removable material when first provided to the game player.

9. The game method of claim 8 wherein the removable material may be removed during the revealing step (B) by scratching the removable material off of the ticket.

10. The game method of claim 7 wherein the game ticket is capable of indicating a plurality of multiplier indicators and the revealing step (B) includes choosing a subset of the plurality of multiplier indicators in order to reveal the one multiplier indicator.

11. The game method of claim 9 wherein the game ticket is capable of indicating a plurality of multiplier indicators and the revealing step (B) includes choosing one among the plurality of multiplier indicators in order to reveal the one multiplier indicator.

12. The game method of claim 11 wherein the second multiplier is determined randomly.

13. The game method of claim 12 wherein the random determination of the second multiplier takes place in a publicized manner at a predetermined and publicly announced time subsequent to the providing step (A).

14. A method of playing a game, comprising:

(A) providing at least one ticket to at least one player, the one ticket comprising game indicia being capable of indicating a winning event and a base prize amount;

(B) determining (i) if the winning event has occurred on the one ticket and (ii) if so, an associated base prize amount;

(C) randomly determining a prize multiplier; and (D) if the winning event occurred in the determining step (B), first multiplying the associated base prize amount by the prize multiplier to obtain a multiplied prize and then awarding the multiplied prize to the one player.

15. The game method of claim 14 wherein the random determination step (C) takes place in a publicized manner at a predetermined time subsequent to the providing step (A), whereby additional players may procure additional multiplied prizes in connection with additional tickets, yielding additional winning events and additional associated base prize amounts, and provided to the additional players prior to the random determination step (C).

16. A method of playing a game, comprising:

(A) providing a plurality of unitary tickets to a plurality of players, each of said unitary tickets comprising game indicia and a plurality of multiplier indicia, the game indicia being capable of indicating a winning event and a winning amount;

(B) allowing each said player to select game indicia and at least one multiplier indicia on at least one of said unitary tickets;

(C) conducting a multiplier game and thereby determining a final game multiplier; and (D) if a winning event occurs and the multiplier indicia selected on a given unitary ticket by a given player is equivalent to the final game multiplier, multiplying said winning amount on said given unitary lottery ticket by the final game multiplier to obtain a product award and awarding the product award to the given player.

17. The game method of claim 16 wherein, on each said unitary ticket, the game indicia and the multiplier indicia are covered at least initially by a removable material when provided during the providing step (A).

18. The game method of claim 17 wherein, on each said unitary ticket, the removable material may be removed by scratching the removable material off of said unitary ticket during the allowing step (B).

19. The game method of claim 18 wherein the multiplier game is conducted in a publicized fashion at a publicly announced, predetermined time subsequent to the providing step (A).

20. A game ticket of the type useable to provide a plurality of game players the opportunity to acquire the game ticket, participate in a lottery, and thereby possibly procure an award based on game indicia on the game ticket, the game ticket comprising in combination:

(A) a unitary ticket body;

(B) base award indicia on the unitary ticket body; and (C) hidden multiplier award indicia on the unitary ticket body, whereby a given game player may reveal the hidden base award indicia and hidden multiplier award indicia and thereby procure a final award based on the product of the hidden base award multiplied by the hidden multiplier award.

21. The game ticket of claim 20 wherein at least the hidden multiplier award indicia is covered by scratchably removable material.

22. The game ticket of claim 20 wherein the base award indicia is hidden and covered by scratchably removable material.

23. The game ticket of claim 21 wherein the base award indicia is hidden and covered by scratchably removable material.

24. A game ticket of the type useable to provide a plurality of game players the opportunity to acquire the game ticket, participate in a lottery, and thereby possibly procure an award based on game indicia on the game ticket, the game ticket comprising in combination:

(A) a unitary ticket body;

(B) hidden base award indicia on the unitary ticket body; and (C) multiplier award indicia on the unitary ticket body, whereby a given game player may reveal the hidden base award indicia and multiplier award indicia and thereby procure a final award based on the product of the hidden base award multiplied by the multiplier award.

25. The game ticket of claim 24 wherein the hidden base award indicia is covered by scratchably removable material.

26. The game method of claim 1 wherein the providing step (A) includes receiving revenue from the player in exchange for providing the ticket to the player.

27. The game method of claim 1 also including as step (E): receiving advertising revenue from at least one advertiser in connection with one or more of steps (A) through (D).

28. The game ticket of claim 24 wherein the multiplier award indicia is hidden.

29. The game method of claim 6 further comprising disqualifying a player from obtaining a prize if the player scratches off more than one of the additional hidden game indicia.

* * * * *